US008985365B2

(12) United States Patent
Chuang

(10) Patent No.: US 8,985,365 B2
(45) Date of Patent: Mar. 24, 2015

(54) CONTAINER STRUCTURE

(71) Applicant: Shan-Chi Chuang, New Taipei (TW)

(72) Inventor: Shan-Chi Chuang, New Taipei (TW)

(73) Assignee: Syn Yao Enterprise Co. Ltd., New Taipei (TW)

( * ) Notice: Subject to any disclaimer, the term of this patent is extended or adjusted under 35 U.S.C. 154(b) by 0 days.

(21) Appl. No.: 13/968,011

(22) Filed: Aug. 15, 2013

(65) Prior Publication Data

US 2014/0117010 A1 May 1, 2014

(30) Foreign Application Priority Data

Oct. 31, 2012 (TW) ..... 101140392 A

(51) Int. Cl.
*B65D 88/12* (2006.01)
*B65D 21/08* (2006.01)
*B65D 88/00* (2006.01)

(52) U.S. Cl.
CPC ..... *B65D 21/08* (2013.01); *B65D 88/005* (2013.01)
USPC ..... 220/8; 220/1.5; 220/4.01; 220/4.03; 220/4.28; 220/668

(58) Field of Classification Search
CPC ..... B65D 88/12; B65D 88/00; B65D 88/005; B65D 21/08
USPC ..... 220/1.5, 4.01, 4.03, 4.28, 8, 668; 52/67, 52/79.5
See application file for complete search history.

(56) References Cited

U.S. PATENT DOCUMENTS 6,494,334 B1 * 12/2002 Cheng ..... 220/1.5
2007/0194018 A1 * 8/2007 Mashburn ..... 220/1.5

* cited by examiner

*Primary Examiner* — Elizabeth Volz
(74) *Attorney, Agent, or Firm* — Che-Yang Chen; Law Office of Michael Chen

(57) ABSTRACT

A container structure is disclosed. The container structure may include a container body and two movable supporting units. When the container body is used as a regular container, two movable supporting units has not been extended from the container body; and the covering rod, extending rod, connecting rods of the movable supporting units are conjugated with the horizontal supporting columns and connecting posts respectively to reinforce the structure of the container body, so that the reinforced container body can have a better status to sustain heavier weight. Furthermore, the movable supporting units can extend to expand the space of the container body to receive more items to reduce the transportation costs; and when the container is not used for storage purposes, the expanded space can be used for other purposes.

4 Claims, 8 Drawing Sheets

CONTAINER STRUCTURE

FIELD OF THE INVENTION

The present invention relates to a container structure, and more particularly to a container structure with expanded space.

BACKGROUND OF THE INVENTION

Conventionally, most containers have a main body structure and a door is disposed at the rear end thereof to upload and unload cargos. However, the inner receiving space of conventional containers is usually fixed and cannot be expanded, so the transportation costs cannot be easily reduced. Furthermore, the containers can be used for other purposes, but the restricted inner space is still a concern under such circumstances. Therefore, there remains a need for a new and improved container structure to overcome the problems discussed above.

SUMMARY OF THE INVENTION

The technical problem the present invention wants to solve is that the inner receiving space of conventional containers is usually fixed and cannot be expanded, so the transportation costs cannot be easily reduced. Furthermore, the containers can be used for other purposes, but the restricted inner space is still a concern under such circumstances.

The present invention provides a container structure may include a container body and two movable supporting units. A plurality of horizontal and vertical supporting columns form an outer frame from front and rear sides of the container body. The horizontal supporting columns of the outer frame connect to a vertical reinforcing column at a center portion thereof, and the horizontal supporting columns is hollow and an opening is formed at end portions thereof. A protection cover covers the opening and the protection cover has a vertical first cover opening and second cover opening. In addition, four corners of the outer frame have connecting columns and a central column is parallelly disposed between two connecting columns. Outer surface of each connecting column has a through hole facing each other, and a plurality of hollow and short connecting posts are inserted into the through hole of the connecting column and pass through the central column, so that the connecting posts are secured between two connecting columns. In addition, a plurality of covering tubes are disposed on both sides of the connecting posts corresponding to the through hole, and a plurality of reinforcing rods parallel to the connecting posts are disposed between the connecting columns.

Two movable supporting units are disposed at both sides of the container body and have corresponding frames according to the shape of the side of the container body. A covering rod is disposed at one side of the corresponding frame corresponding to the first cover opening of the protection cover, and a extending rod is disposed at the other side corresponding to the second cover opening of the protection cover. A plurality of connecting rod are orderly disposed between the covering rod and extending rod, wherein the connecting rod of one movable supporting unit is corresponding to the connecting post, and the connecting rod of the other movable supporting unit is corresponding to the connecting post, so that the two movable supporting units can be inserted into both sides of the container body, and the corresponding frames of the movable supporting units have vertical supporting ribs which are perpendicular to the connecting rods.

Comparing with the prior arts, the present invention is advantageous because when the container body is used as a regular container, two movable supporting units has not been extended from the container body; and the covering rod, extending rod, connecting rods of the movable supporting units are conjugated with the horizontal supporting columns and connecting posts respectively to reinforce the structure of the container body, so that the reinforced container body can have a better status to sustain heavier weight.

Furthermore, the movable supporting units can extend to expand the space of the container body to receive more items to reduce the transportation costs; and when the container is not used for storage purposes, the expanded space can be used for other purposes.

DETAILED DESCRIPTION OF THE INVENTION

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

Figure 1:
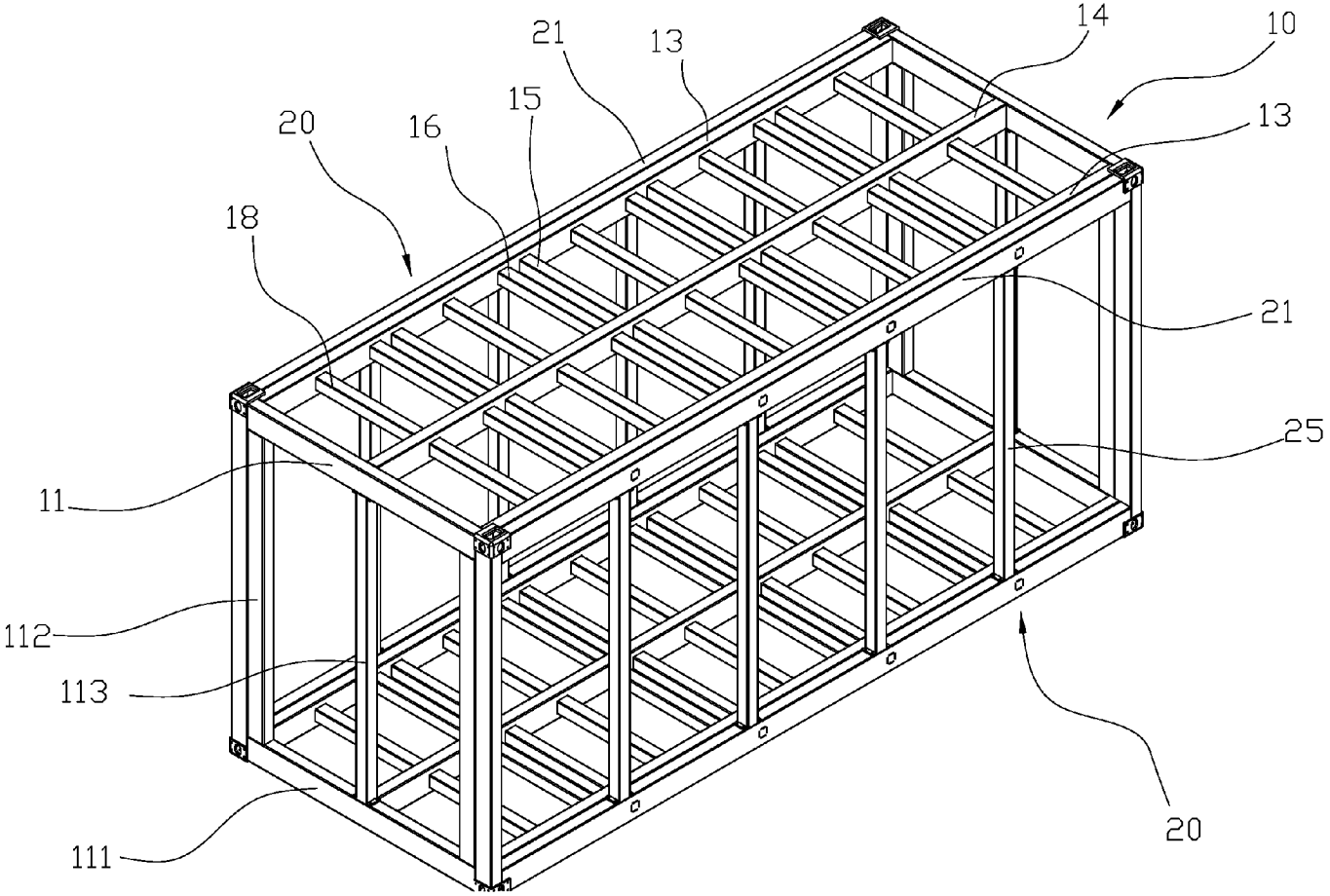
FIG. 1 illustrates a three-dimensional view of the present invention.
Figure 2:
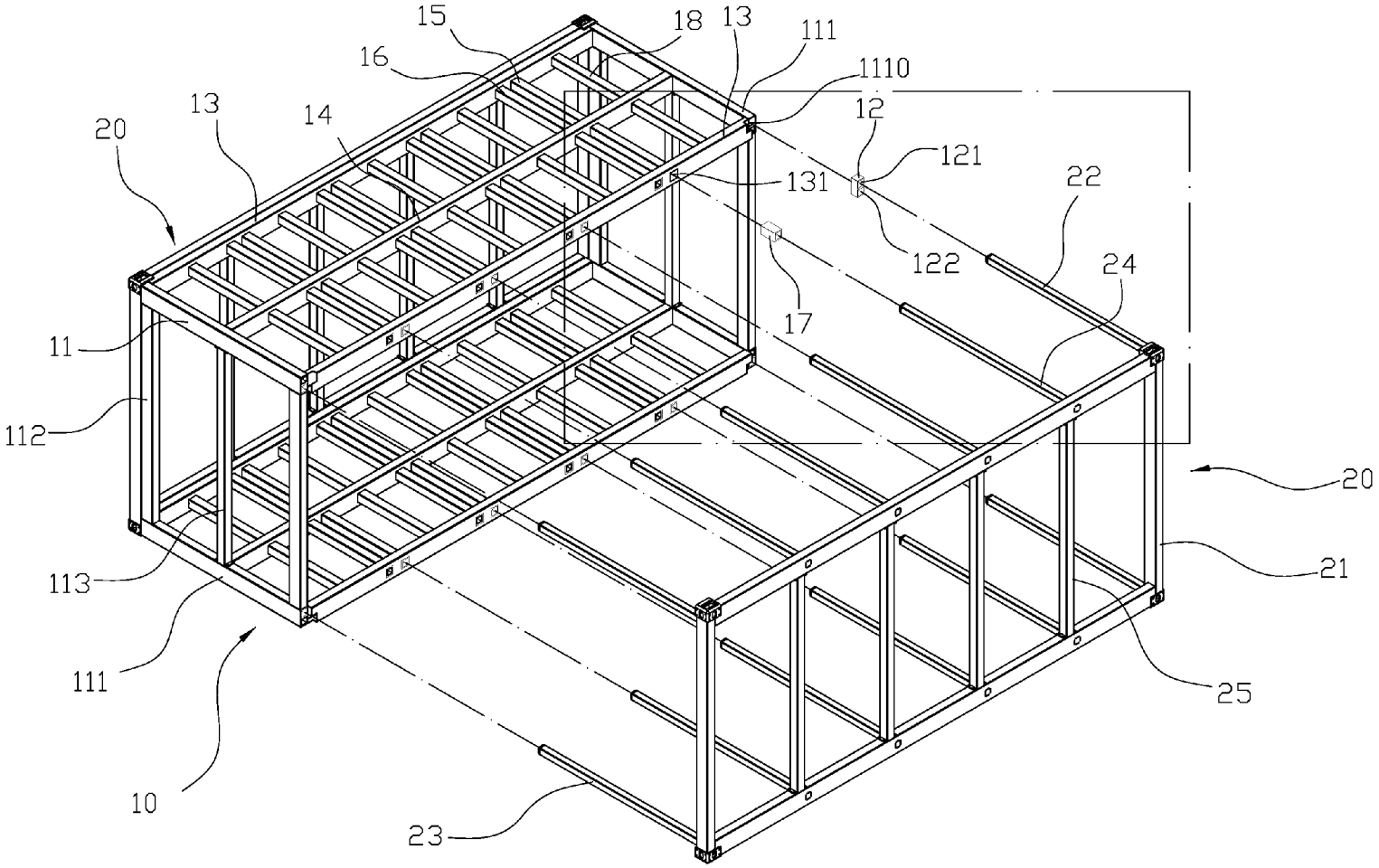
FIG. 2 illustrates an exploded view of the container structure in the present invention.
Figure 3:
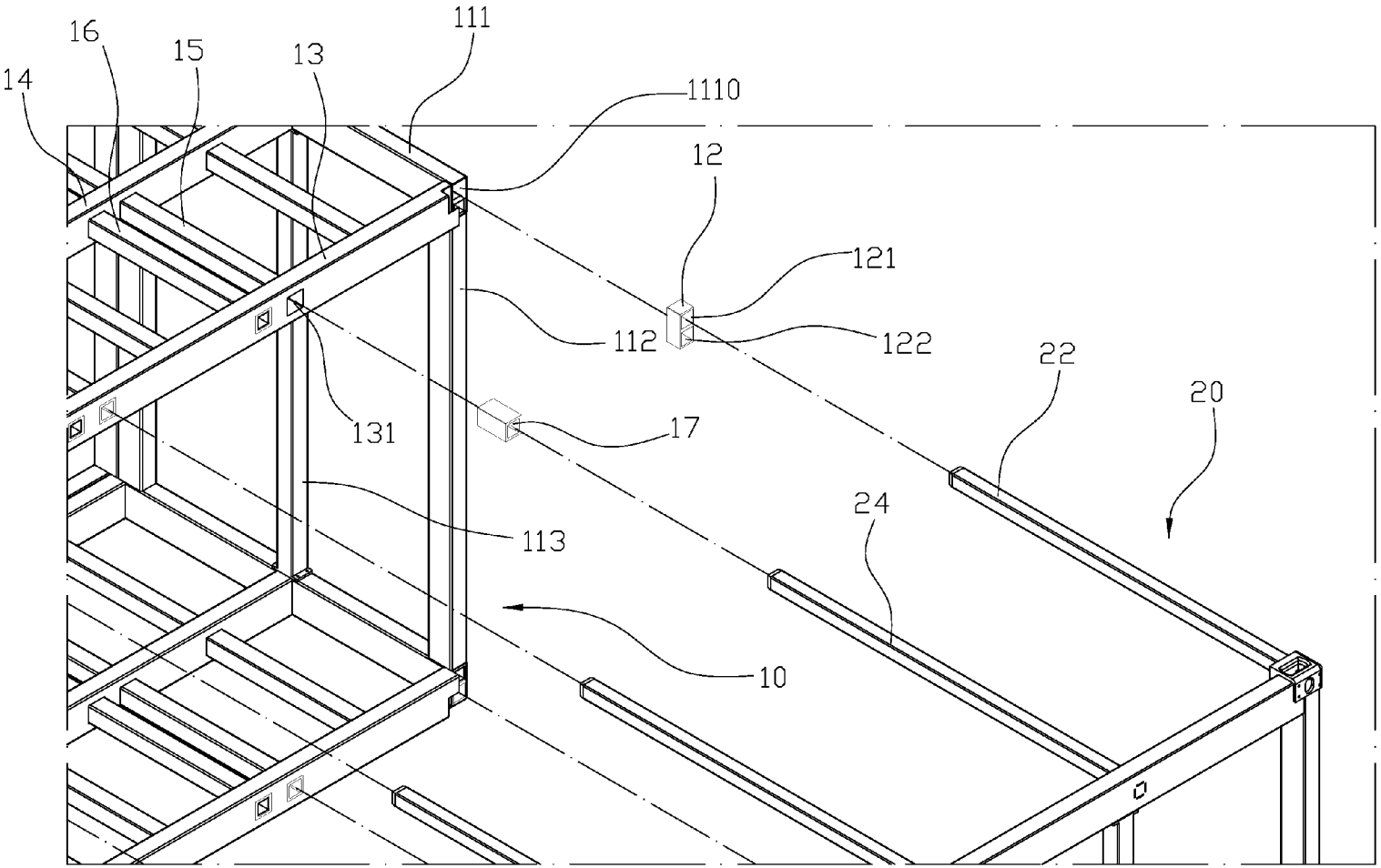
FIG. 3 illustrates a partial enlarged view of FIG. 2 in the present invention.

In order to further understand the goal, characteristics and effect of the present invention, a number of embodiments along with the drawings are illustrated as following:

Referring to FIGS. 1, 2 and 3, a container structure may include a container body 10 and two movable supporting units 20. A plurality of horizontal and vertical supporting columns 111, 112 form an outer frame 11 from front and rear sides of the container body 10. The horizontal supporting columns 111 of the outer frame 11 connect to a vertical reinforcing column 113 at a center portion thereof, and the horizontal supporting columns 111 is hollow and an opening 1110 is formed at end portions thereof. A protection cover 12 covers the opening 1110 and the protection cover 12 has a vertical first cover opening 121 and second cover opening 122. In addition, four corners of the outer frame 11 have connecting columns 13 and a central column 14 is parallelly disposed between two connecting columns 13. Outer surface of each connecting column 13 has a through hole 131 facing each other, and a plurality of hollow and short connecting posts 15 and 16 are inserted into the through hole 131 of the connecting column 13 and pass through the central column 14, so that the connecting posts 15 and 16 are secured between two connecting columns 13. In addition, a plurality of covering tubes 17 are disposed on both sides of the connecting posts 15 and 16 corresponding to the through hole 131, and a plurality of reinforcing rods 18 parallel to the connecting posts 15 and 16 are disposed between the connecting columns 13.

Two movable supporting units 20 are disposed at both sides of the container body 10 and have corresponding frames 21 according to the shape of the side of the container body 10. A covering rod 22 is disposed at one side of the corresponding frame 21 corresponding to the first cover opening 121 of the protection cover 12, and a extending rod 23 is disposed at the other side corresponding to the second cover opening 122 of the protection cover 12. A plurality of connecting rod 24 are orderly disposed between the covering rod 22 and extending rod 23, wherein the connecting rod 24 of one movable supporting unit 20 is corresponding to the connecting post 15, and the connecting rod 24 of the other movable supporting unit 20 is corresponding to the connecting post 16, so that the two movable supporting units 20 can be inserted into both sides of the container body 10, and the corresponding frames 21 of the movable supporting units 20 have vertical supporting ribs 25 which are perpendicular to the connecting rods 24.

Figure 4:
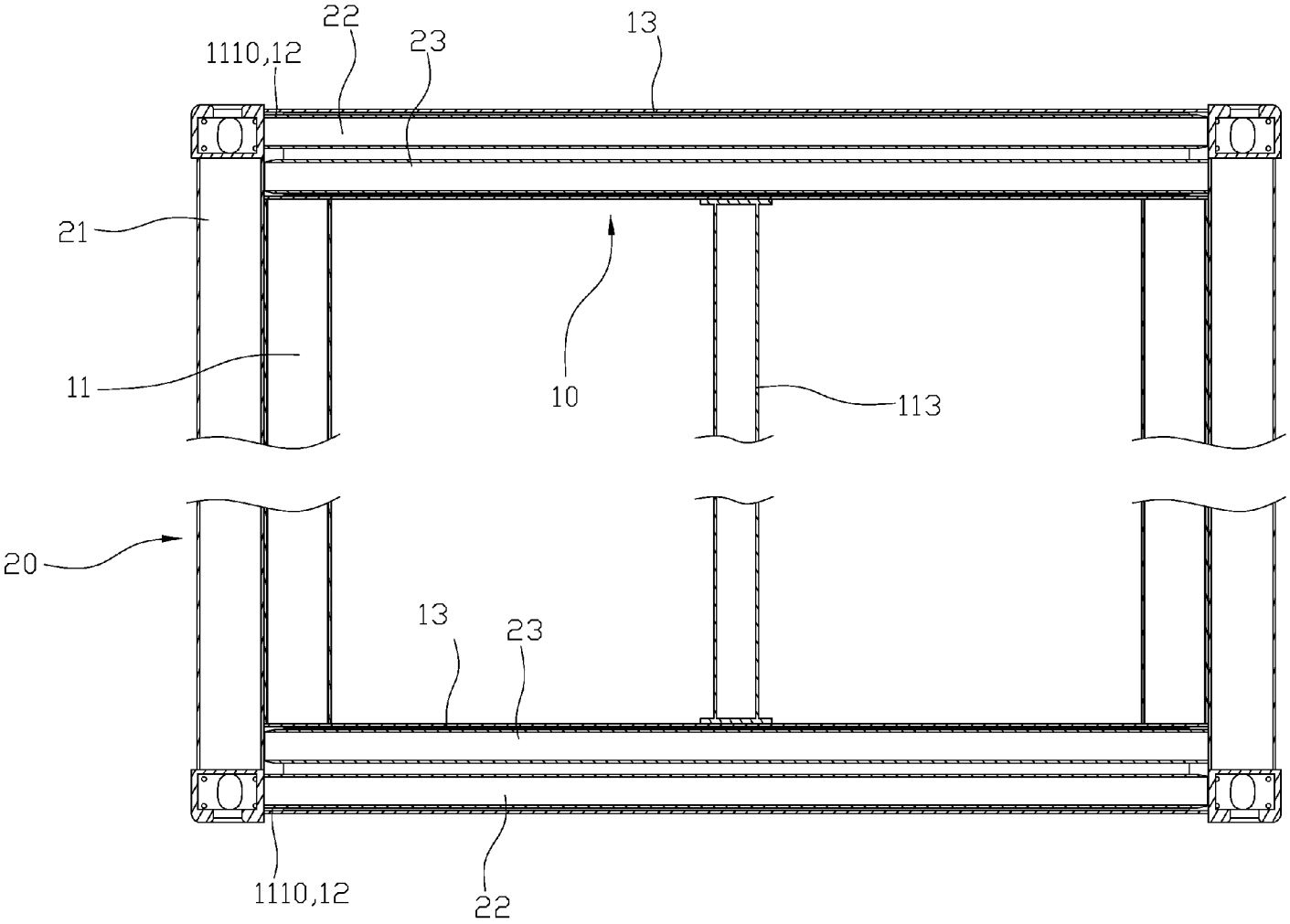
FIG. 4 illustrates a sectional view of container structure in the present invention.

Referring to FIGS. 2 to 4 for the structure, the container body 10 has the movable supporting units 20 on both sides thereof, and when the movable supporting units 20 are disposed at left and right sides thereof, the two movable supporting units 20 are inserted from both sides of the container body 10 into the opening 1110 of the horizontal supporting columns 111 through the covering rod 22 and extending rod 23, the covering rod 22 is inserted into the first cover opening 121 of the protection cover 12, and the extending rod 23 is inserted into the second cover opening 122 of the protection cover 12, so that the covering rod 22 and extending rod 23 of the movable supporting units 20 can be disposed in every horizontal supporting columns and separated by the protection cover 12. Moreover, one side of the connecting rods 24 can be inserted into the connecting post 15, while the other side of the connecting rods 24 is inserted into the connecting post 16, so that the connecting rods 24 of the supporting units 20 can be spaced and crossed between the connecting columns 13 of the container body 10. Also, the covering tubes 17 are used to protect the connecting posts 15 and 16 from being damaged when the connecting rods 24 are inserted therein. According to the structure discussed above, the assembly of the container body 10 and two movable supporting units 20 is completed.

Figure 5:
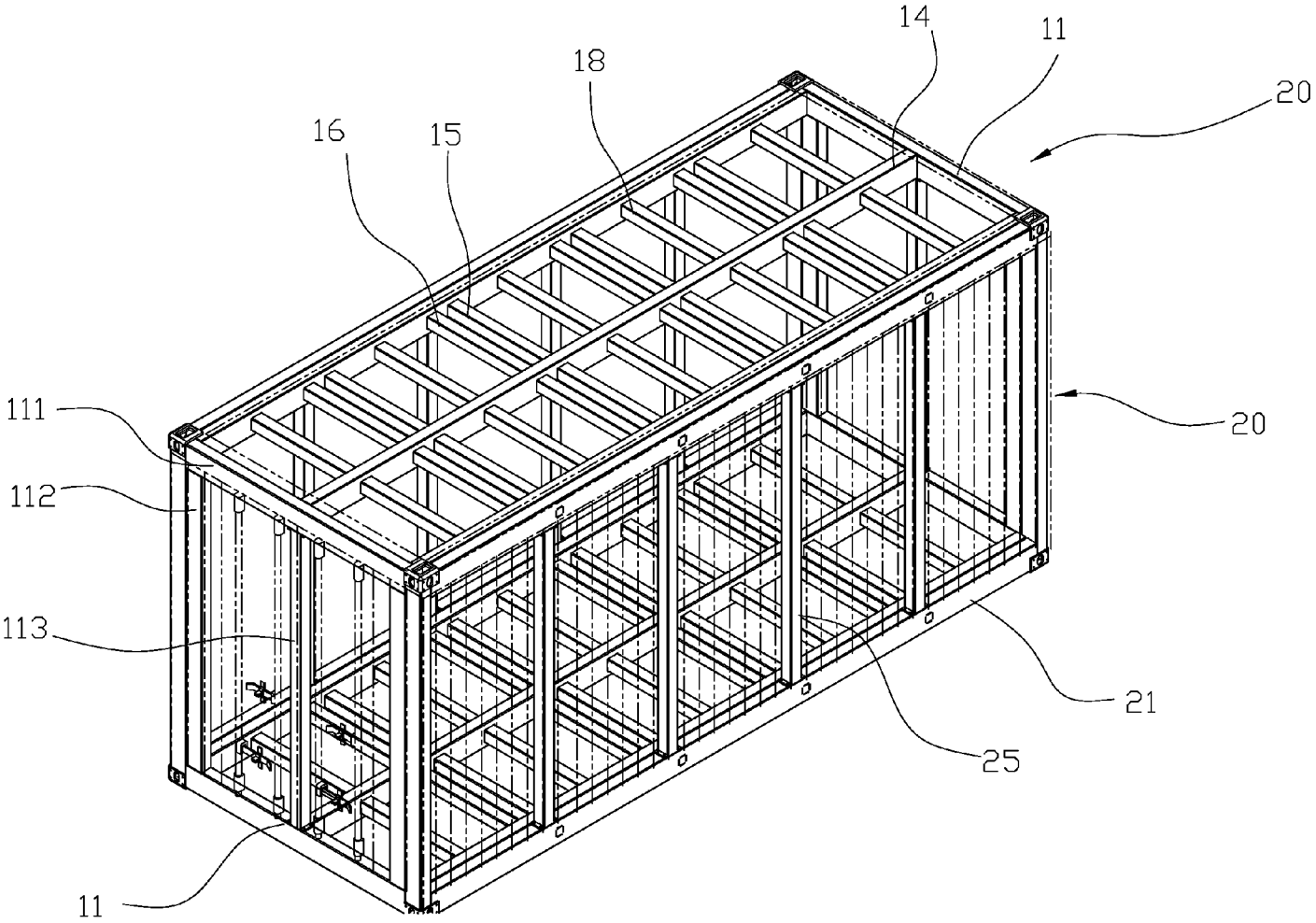
FIG. 5 illustrates a schematic view of the container structure in the present invention when it is in use.

When the container body 10 is used as a regular container shown in FIG. 5, two movable supporting units 20 has not been extended from the container body 10; and the covering rod 22, extending rod 23, connecting rods 24 of the movable supporting units 20 are conjugated with the horizontal supporting columns 111 and connecting posts 15 and 16 respectively to reinforce the structure of the container body 10, so that the reinforced container body 10 can have a better status to sustain heavier weight.

Figure 6:
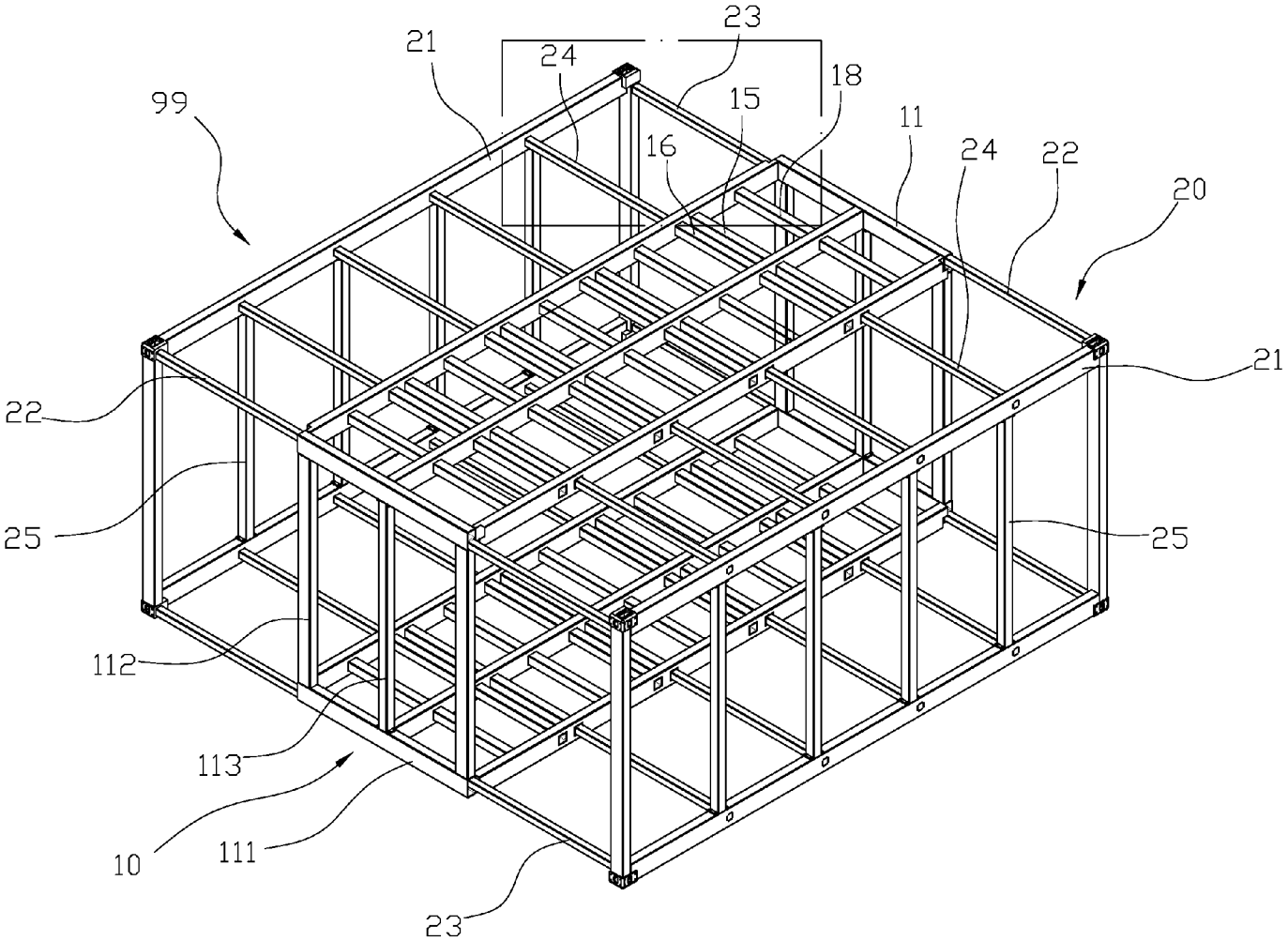
FIG. 6 illustrates a schematic view of the container structure with expanded space in the present invention.
Figure 7:
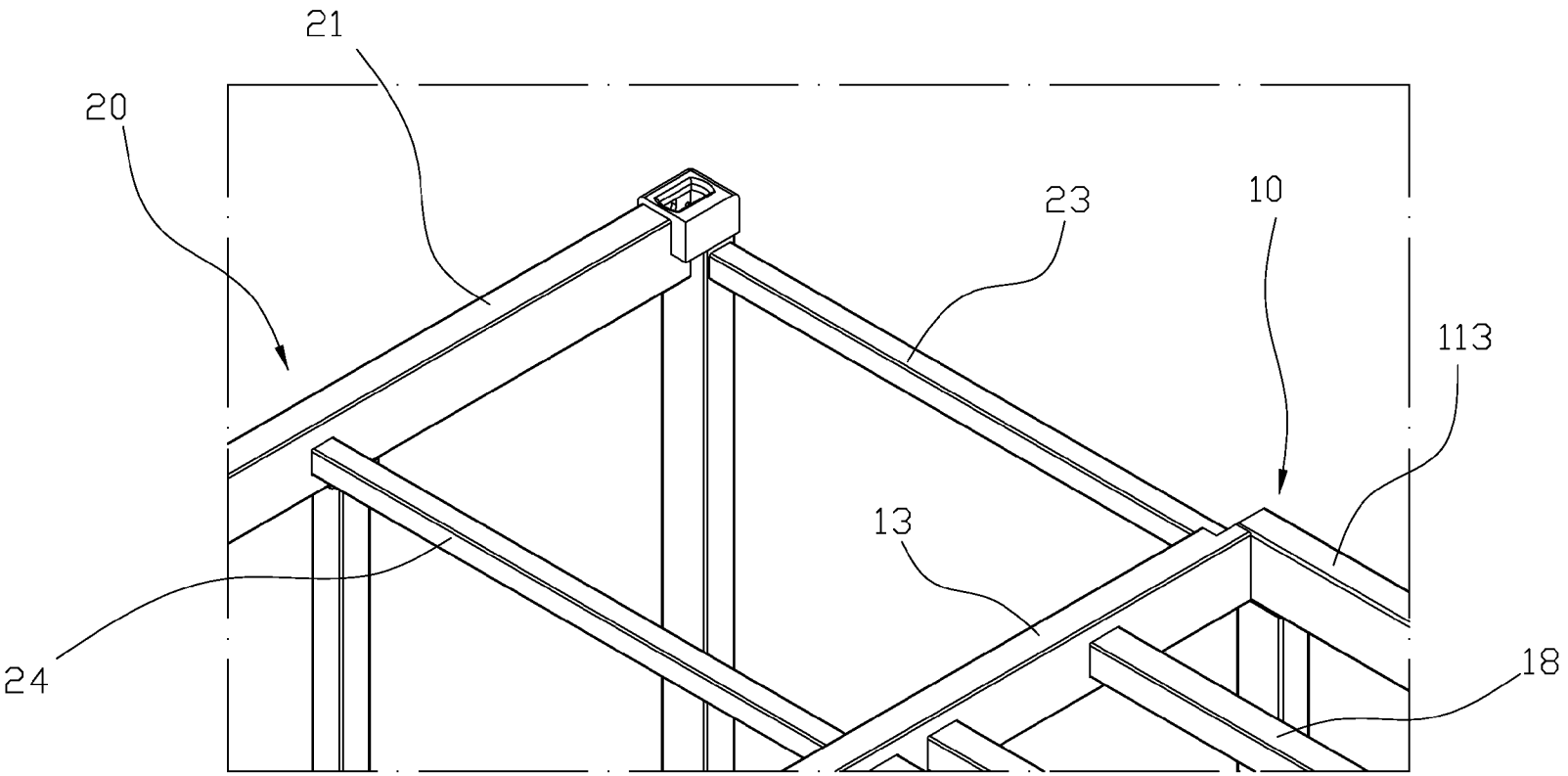
FIG. 7 illustrates a partial enlarged view of FIG. 6 in the present invention.
Figure 8:
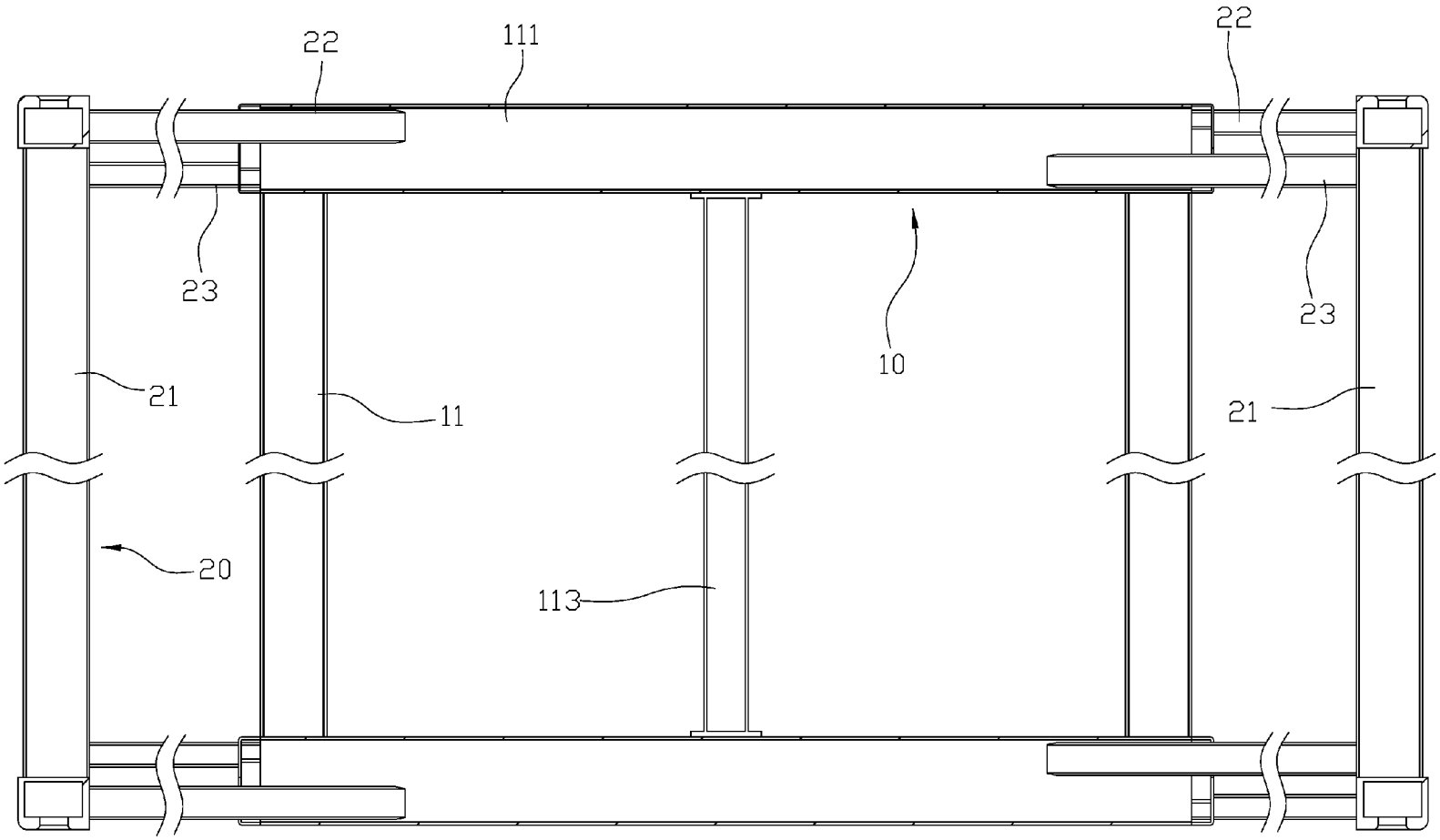
FIG. 8 is a sectional view of the expanded usage of the container in the present invention.

In another embodiment shown in FIGS. 6 to 8, the covering rod 22, extending rod 23, connecting rods 24 of the movable supporting units 20 are conjugated with the horizontal supporting columns 111 and connecting posts 15 and 16 respectively, so that the covering rod 22, extending rod 23, connecting rods 24 of the movable supporting units 20 can utilize the horizontal supporting columns 111 and connecting posts 15 and 16 as rails to extend the movable supporting units 20 from the container body 10. Therefore, the space of the container body can be expanded through the extended supporting unit 20; and when the container is not used for storage purposes, the expanded space can be used as a temporary housing or hut.

According to the embodiments described above, the present invention is advantageous because when the container body 10 is used as a regular container, two movable supporting units 20 has not been extended from the container body 10; and the covering rod 22, extending rod 23, connecting rods 24 of the movable supporting units 20 are conjugated with the horizontal supporting columns 111 and connecting posts 15 and 16 respectively to reinforce the structure of the container body 10, so that the reinforced container body 10 can have a better status to sustain heavier weight.

Furthermore, the movable supporting units 20 can extend to expand the space of the container body 10 to receive more items to reduce the transportation costs; and when the container is not used for storage purposes, the expanded space can be used for other purposes.

Having described the invention by the description and illustrations above, it should be understood that these are exemplary of the invention and are not to be considered as limiting. Accordingly, the invention is not to be considered as limited by the foregoing description, but includes any equivalents.

What is claimed is:

1. A container structure comprising:

a container body, having a front outer frame located at a front end of said container body and a rear outer frame at a rear end thereof, each of said front outer frame and rear outer frame including a plurality of horizontal and vertical supporting columns, wherein said horizontal supporting columns is hollow and an opening is formed at end portions thereof, and a protection cover that covers the opening has a vertical first cover opening and second cover opening, wherein four corners of the outer frame have connecting columns and a central column is parallelly disposed between two connecting columns, and outer surface of each connecting column has a through hole facing each other, and a plurality of hollow and short connecting posts are inserted into the through hole of the connecting column and pass through the central column, so that the connecting posts are secured between two connecting columns, and wherein a plurality of covering tubes are disposed on both sides of the connecting posts corresponding to the through hole; and two movable supporting units, one of which disposed at one side of the container body, and the other one of which disposed at the other side thereof, and each of said movable supporting units having a corresponding frame according to the shape of the container body, wherein a covering rod is disposed at one side of the corresponding frame corresponding to the first cover opening of the protection cover, and a extending rod is disposed at the other side corresponding to the second cover opening of the protection cover, and a plurality of connecting rod are orderly disposed between the covering rod and extending rod, wherein the connecting rod of one movable supporting unit is corresponding to the connecting post, and the connecting rod of the other movable supporting unit is corresponding to the connecting post, so that the two movable supporting units are able to be inserted into both sides of the container body.

2. The container structure of claim 1, wherein the horizontal supporting columns of the outer frame connect to a vertical reinforcing column at a center portion of the horizontal supporting columns.

3. The container structure of claim 1, wherein a plurality of reinforcing rods parallel to the connecting posts are disposed between the connecting columns.

4. The container structure of claim 1, wherein the corresponding frames of the movable supporting units have vertical supporting ribs that are perpendicular to the connecting rods.

* * * * *